US005367428A

United States Patent [19]

Aresco et al.

[11] Patent Number: 5,367,428

[45] Date of Patent: Nov. 22, 1994

[54] INTEGRATED SAFETY DISCHARGE MODULE

[75] Inventors: Carmelo A. Aresco, Middletown; Andrew J. Turano, Wallingford, both of Conn.

[73] Assignee: Raymond Engineering Inc., Middletown, Conn.

[21] Appl. No.: 992,694

[22] Filed: Dec. 18, 1992

[51] Int. Cl.[5] ..... F23Q 3/00

[52] U.S. Cl. ..... 361/251; 102/202.5

[58] Field of Search ..... 361/247, 248, 251, 253, 361/261; 102/202.5

[56] References Cited

U.S. PATENT DOCUMENTS

| | | | |
|---|---|---|---|
| 3,717,794 | 2/1973 | Yates et al. | 361/251 |
| 4,038,019 | 7/1977 | Matthews | 361/253 |
| 4,769,734 | 9/1988 | Heinemeyer et al. | 361/56 |
| 5,146,104 | 9/1992 | Schumacher et al. | 307/10.1 |

*Primary Examiner*—Jeffrey A. Gaffin

*Attorney, Agent, or Firm*—Fishman, Dionne & Cantor

[57] ABSTRACT

An integrated safety discharge module for providing a high voltage high current pulse to a load includes a capacitor and a bleed resistor, The capacitor is connected to the bleed resistor by such means as to form a structure which ensures that failure of either the capacitor or the bleed resistor will preclude charging of the capacitor and/or the delivery of energy to the load, The unit may also include a circuit for providing visual indication of a threshold charge on the capacitor.

14 Claims, 1 Drawing Sheet

INTEGRATED SAFETY DISCHARGE MODULE

BACKGROUND OF THE INVENTION

This invention relates, in general, to the field of high voltage, high energy capacitor discharge devices and, more particularly, to their use with electronic safe and arming devices.

Capacitor discharge devices have been employed in various electronic devices including safe and arm devices, laser firing systems and plasma generators. While the present invention will be described in the environment of a detonator for safe and arm system explosive, it will be understood that the invention is suitable for use in any application in which a high power capacitor discharge device is desired. In electronic safe and arm devices a capacitor is utilized to provide a high energy pulse to a load, e.g. a foil or film detonator. The energy pulse when coupled with a foil detonator, vaporizes the foil to initiate an explosion and one such system is described in U.S. Pat. No. 4,602,565 ('565 patent). In a typical prior art capacitor discharge system, such as in the '565 patent, the capacitor is in a circuit with the foil detonator and a normally open switch, and the capacitor is normally in an uncharged state. When it is desired to arm the system, the capacitor is charged, e.g., to 3000 volts; when it is desired to initiate the explosion, the switch is closed and the capacitor discharges very quickly (in nanoseconds) to vaporize the foil and initiate the explosion. A high resistance bleed resistor connected across the capacitor is used to bleed off the charge on the capacitor in the event that the latter is charged (i.e., armed) but then not discharged into the load if a decision is made not to "fire" a system after it has been "armed". The voltage drops across the bleed resistors is monitored to determine whether the system is armed or safe. Prior art structures for connecting the capacitor and bleed resistor together included conventional devices such as a flexible or rigid printed wire board. A problem with such prior art structures is that occasionally the bleed resistor may become electrically disconnected from the circuit. This problem is particularly serious when such a disconnection occurs while the capacitor is charged. In that structure the voltage drop across the bleed resistor is zero, indicating a safe system when, in fact, the capacitor may be charged and in an armed state. That is a very dangerous situation in that the system appears to be safe, but it is not. Closure of the switch in this situation will lead to the catastrophic result of an unintended firing of the system (explosive charge, bomb, etc.).

Another problem with prior art system is that after a failure in the connection between the bleed resistor and the capacitor, a safe (i.e., uncharged) capacitor can still be charged (i.e., armed), and the system can be fired by closure of the switch. This is a second unsafe and very dangerous condition.

SUMMARY OF THE INVENTION

The above-discussed and other problems and deficiencies of prior art are overcome or alleviated by the integral structure of the present invention.

In accordance with the present invention, a resistor consititutes both a primary charging element and a bleed resistor. The resistor and the capacitor are formed into a unitary and integrated structure. The resistor is mounted upon the capacitor, and the resistor is connected to metallized end plates of the capacitor by leaf spring elements rather than by conventional wires or printed circuits. The structure is encapsulated in epoxy resin and is connected in a circuit with a switch and a foil detonator.

The structure of the present invention eliminates or at least greatly reduces the risk of a failure in the connection between the resistor and the capacitor. Also, it prevents both the charging and discharging of the capacitor in the unlikely event of a failure in the connection between the resistor and capacitor and thereby reduces the risk of an accidental discharge.

In an alternate embodiment, an additional circuit is connected with the capacitor to provide a visual indication of a charge on the capacitor. The visual indicator may be in the form of a blinking LED or a light shutter.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
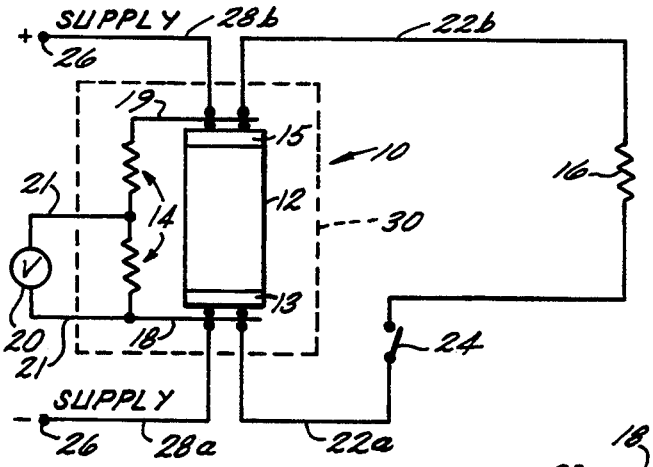
FIG. 1 is an electrical schematic of a capacitor discharge detonator of the present invention.

Referring jointly to FIGS. 1–4, a capacitor discharge module of the present invention is depicted generally at 10 and includes a capacitor 12 and a charge/bleed resistor 14 which are connected to a foil resistor load 16. Capacitor 12 is preferably of the low-inductance type capable of retaining a charge on the order of approximately 3000 volts such as that described in U.S. Pat. No. 4,502,096 (which is incorporated in its entirety herein by reference), and it has metallized end plates or caps 13, 15 at opposite ends which are connected to alternate metal layers in capacitor 12. Charge/bleed resistor 14 is mounted directly on top of capacitor 12 between end plates 13, 15 and provides both a charging path for capacitor 12 and a feedback loop for discharging capacitor 12 when the operator elects not to detonate the load 16. Thus, resistor 14 must be high in resistance to prevent premature discharge of the capacitor 12. Leaf spring conductors 18, 19 which will be more fully described hereinafter, are solder connected to end plates 13, 15, respectively, to couple resistor 14 in parallel with the capacitor 12. A voltage monitor 20 is joined in circuit with voltage divider line 21 and bleed resistor 14 and is used to monitor the level of charge on the capacitor 12. Load 16 is connected by conductors *22a, 22b* to the leaf spring leads 18, 19. A switch 24 is provided for the operator to complete the circuit between the capacitor 12 and the load 16. A 3000 volt power supply 26 is selectively connected to leaf springs 18, 19 and end plates 13, 15 by leads *28a, 28b* via a switch (not shown) to charge capacitor 12.

In operation, capacitor 12 is charged by connecting supply 26 to leaf springs 18, 19 and end plates 13, 15.

Once the capacitor has been charged, it may be discharged either through the load 16 by closing of switch 24 or by trickling back through the resistor 14. Since supply 26 is connected directly to leaf spring leads 18, 19, and to end plates 13, 15, resistor 14 is in the circuit for both charging and bleeding down the capacitor, while instantaneous discharge of the capacitor is through load 16 when switch 24 is closed.

Figure 2:
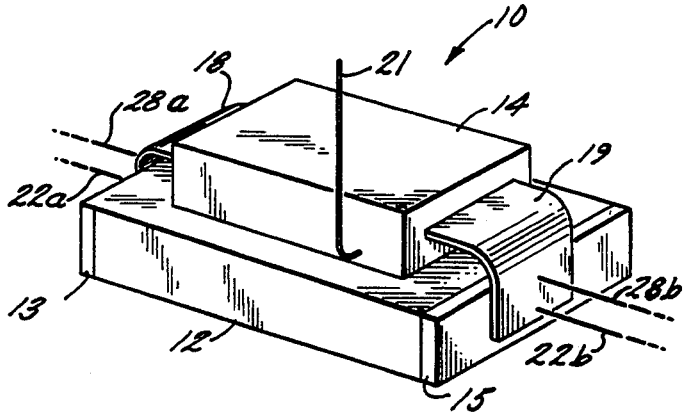
FIG. 2 is a perspective view of a capacitor discharge detonator of the present invention.
Figure 3:
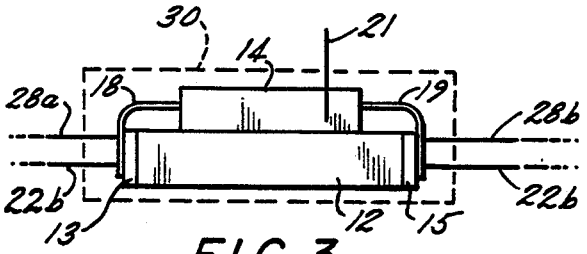
FIG. 3 is a front elevation of the device of FIG. 2.
Figure 4:
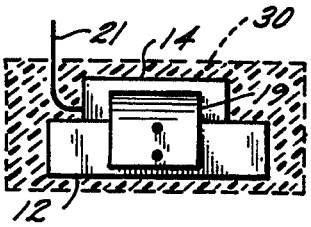
FIG. 4 is a side elevation of the device of FIG. 2.

Leaf spring conductors 18, 19 extend from resistor 14 and may be formed of any suitable material; preferably tin plated copper. As best seen in FIG. 2, resistor 14 is mounted directly on capacitor 12 and is connected by flat conductor leaf spring type material 18, 19 to the capacitor 14. Leaf spring conductors 18, 19 are of a generally rectangular shape and are much heavier and stronger than ordinary wire conductors, so they significantly reduce the risk of a break in the connections between the resistor 14 and the capacitor 12. The assembly of the capacitor 12, resistor 14 and leaf springs 18, 19 is also encapsulated in an epoxy resin 30 (as indicated by the dashed envelope lines in FIGS. 1, 3 and 4) to further reduce the risk of connection failure.

It is also to be noted that the conductors **22*a*, 22*b* and 28*a*, 28*b* are connected directly to the leaf spring conductors 18, 19, so the only electrical path to or from capacitor 12 is through the soldered connections between leaf springs 18, 19 and the capacitor plates 13, 15. A break in one of those solder connections results in both an open circuit from power supply 26 to the capacitor 12 and an open circuit from capacitor 12 to load 16, thus preventing the capacitors from being charged or discharged. That is, the device of this invention "fails safe." Also, if a break should occur in one of leaf spring connectors 18 or 19 at a location removed from end plates 13 or 15, the potting compound 30 will keep the broken parts either in contact or close enough together so that the 3000 volt charge will bridge any small gap, whereby the bleed circuit from capacitor through resistor 14** will remain intact to preserve the safety of the system.

Figure 5:
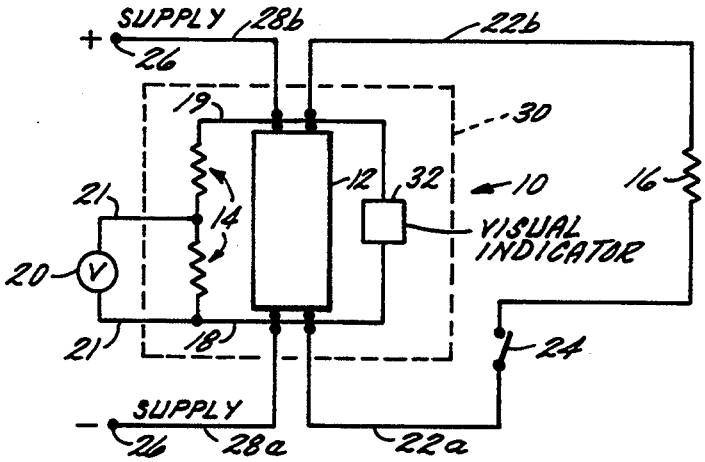
FIG. 5 is alternate embodiment of an electrical schematic of a capacitor discharge detonator of the present invention.

Referring to FIG. 5, an alternate embodiment includes a visual indicator circuit 32 connected in parallel with the capacitor 12 and resistor 14. The indicator circuit 32 is provided as an additional visual display to indicate whether there is a threshold charge on the capacitor 12. This circuit may be of any general type which will give notice to the operator that the capacitor 12 is charged at some threshold level. For example, the threshold value could be set at approximately 500 V on the capacitor 12; and upon reaching that minimum charge a light emitting diode would begin to blink or a light shutter would change to opaque or clear.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An integrated safety discharge module comprising:

a capacitor;

bleed means for bleeding off a charge on said capacitor;

a pair of leaf spring conductors integrally connecting said capacitor with said bleed means;

load means connected in circuit to receive discharge from said capacitor; and normally open switch means for connecting said capacitor with said load.

2. An integrated safety discharge module as in claim 1, wherein:

said bleed means includes a voltage divider resistive circuit.

3. An integrated safety discharge module as in claim 2, including:

voltage measuring means connected in circuit with said voltage divider circuit.

4. An integrated safety discharge module as in claim 1, wherein:

said capacitor includes outer conductive plates connected to inner conductive plates of said capacitor and to said leaf spring leads.

5. An integrated safety discharge module as in claim 1 wherein:

said capacitor, said bleed means and said leaf springs are encapsulated.

6. An integrated safety discharge module as in claim 5 wherein:

said leaf springs are encapsulated in a resin compound.

7. An integrated safety discharge module comprising:

a capacitor;

bleed means for bleeding off a charge on said capacitor;

a pair of leaf spring conductors integrally connecting said capacitor with said bleed means;

load means connected in circuit to receive discharge from said capacitor;

normally open switch means for connecting said capacitor with said load; and visual indicator circuit means connected in circuit with said capacitor for indicating threshold charge level on said capacitor.

8. An integrated safety discharge module as in claim 7, wherein:

said visual indicator circuit means includes a light emitting diode.

9. An integrated safety discharge module as in claim 7, wherein:

said visual indicator circuit means includes an electrically operated optical device.

10. An integrated safety discharge module as in claim 7, wherein:

said bleed means includes a voltage divider resistive circuit.

11. An integrated safety discharge module as in claim 10, including:

a voltage measuring device connected in circuit with said voltage divider resistive circuit.

12. An integrated safety discharge module as in claim 7, wherein:

said capacitor includes outer conductive plates connected to inner conductive plates of said capacitor and to said leaf spring leads.

13. An integrated safety discharge module as in claim 12 wherein:

said leaf springs are encapsulated in a resin compound.

14. An integrated safety discharge module of claim 7, wherein:

said capacitor, said means for bleeding off a charge on the capacitor and said leaf springs are encapsulated.

* * * * *